US012012253B1

(12) United States Patent
Yu et al.

(10) Patent No.: US 12,012,253 B1
(45) Date of Patent: Jun. 18, 2024

(54) LIGHTWEIGHT POLYMER WINE BOTTLE SUITABLE FOR USE WITH NATURAL CORK OR SYNTHETIC STOPPERS

(71) Applicant: Verre Vert, Inc., South San Francisco, CA (US)

(72) Inventors: Shan Yu, South San Francisco, CA (US); Dylan Robbins, Greenwich, CT (US); Dustin Wilson, New York, NY (US)

(73) Assignee: Verre Vert, Inc., South San Francisco, CA (US)

( * ) Notice: Subject to any disclaimer, the term of this patent is extended or adjusted under 35 U.S.C. 154(b) by 0 days.

(21) Appl. No.: 18/362,802

(22) Filed: Jul. 31, 2023

Related U.S. Application Data

(60) Provisional application No. 63/488,060, filed on Mar. 2, 2023.

(51) Int. Cl.
*B65D 23/08* (2006.01)
*B65D 1/02* (2006.01)
*B65D 23/02* (2006.01)

(52) U.S. Cl.
CPC ..... *B65D 23/0821* (2013.01); *B65D 1/0215* (2013.01); *B65D 23/02* (2013.01); *B65D 2590/026* (2013.01)

(58) Field of Classification Search
CPC .. B65D 1/0207; B65D 1/0215; B65D 1/0223; B65D 1/023; B65D 1/02–023; B65D 25/14; B65D 23/02; B65D 2501/0009; B65D 2501/24808; B32B 27/36; B32B 2439/70; B29D 22/003; B29D 22/006; B29L 2031/7158
USPC ..... 428/35.7, 36.9, 34.1–36.92
See application file for complete search history.

(56) References Cited

U.S. PATENT DOCUMENTS

| | | | | |
|---|---|---|---|---|
| 3,093,507 | A | 6/1963 | Lander et al. | |
| 3,282,729 | A | 11/1966 | Richardson et al. | |
| 3,415,402 | A | 12/1968 | Webber | |
| 4,282,279 | A | 8/1981 | Strickland | |
| 4,288,478 | A * | 9/1981 | Kinoshita et al. | B65D 1/00 428/35 |

(Continued)

FOREIGN PATENT DOCUMENTS

| | | |
|---|---|---|
| BR | 8907337 A | 5/1991 |
| CA | 3015446 A1 | 11/2017 |

(Continued)

OTHER PUBLICATIONS

"Guide to Wine Bottle Shapes", Firstleaf, accessed online Oct. 2023, pp. 14-17, https://www.firstleaf.com/wine-school/article/guide-wine-bottle-shapes (Year: 2023).*

(Continued)

*Primary Examiner* — Michael C Romanowski
(74) *Attorney, Agent, or Firm* — Ascenda Law Group, PC

(57) ABSTRACT

A container for alcohol, e.g., a wine bottle, formed of a polymer wall has a body that terminates in a base, a shoulder, and a neck, the shoulder forming a tapered region between the neck and the body, and the neck terminating in a finish. The polymer wall is sufficiently thick to withstand extraction forces, one hour after capping, of between 12 and 40 daN when a natural cork stopper is used and between 10 and 45 daN when a synthetic stopper is used.

10 Claims, 2 Drawing Sheets

(56) References Cited

U.S. PATENT DOCUMENTS

| | | | | |
|---|---|---|---|---|
| 4,393,106 | A | 7/1983 | Maruhashi et al. | |
| 4,482,586 | A | 11/1984 | Smith et al. | |
| 4,564,541 | A | 1/1986 | Taira et al. | |
| 4,620,639 | A * | 11/1986 | Yoshino | B65D 1/0276 215/373 |
| 4,699,809 | A | 10/1987 | Maruhashi et al. | |
| 4,792,488 | A | 12/1988 | Schirmer | |
| 4,801,078 | A | 1/1989 | Carlsson | |
| 4,811,849 | A | 3/1989 | Rausing | |
| 4,816,304 | A | 3/1989 | Nohara et al. | |
| 4,818,575 | A | 4/1989 | Hirata et al. | |
| 4,836,971 | A * | 6/1989 | Denis | B29C 49/6472 264/530 |
| 4,980,211 | A | 12/1990 | Kushida et al. | |
| 5,021,515 | A | 6/1991 | Cochran et al. | |
| 5,084,356 | A | 1/1992 | Deak et al. | |
| 5,085,821 | A | 2/1992 | Nohara | |
| 5,122,410 | A | 6/1992 | Lofgren et al. | |
| 5,300,541 | A | 4/1994 | Nugent, Jr. et al. | |
| 5,637,365 | A | 6/1997 | Carlblom | |
| 5,688,598 | A | 11/1997 | Keck et al. | |
| 5,750,226 | A | 5/1998 | MacAuley et al. | |
| 5,800,880 | A | 9/1998 | Laurent | |
| 5,853,830 | A | 12/1998 | McCaulley et al. | |
| 5,858,543 | A | 1/1999 | Futter et al. | |
| 5,947,310 | A * | 9/1999 | Wagner | B65D 23/04 215/320 |
| 6,013,128 | A | 1/2000 | Hubbard et al. | |
| 6,029,837 | A * | 2/2000 | Slat | B65D 1/0223 215/382 |
| 6,082,563 | A | 7/2000 | Kohn et al. | |
| 6,368,686 | B1 | 4/2002 | Lofgren et al. | |
| 6,489,386 | B1 | 12/2002 | Plotzker et al. | |
| 6,499,311 | B2 | 12/2002 | Mahajan | |
| 6,641,774 | B2 | 11/2003 | Slat et al. | |
| 6,676,883 | B2 | 1/2004 | Hutchinson et al. | |
| 6,939,591 | B2 | 9/2005 | Hutchinson et al. | |
| 7,214,415 | B2 | 5/2007 | Tibbitt et al. | |
| 7,727,605 | B2 | 6/2010 | Darr et al. | |
| 8,377,530 | B2 | 2/2013 | Peters et al. | |
| 10,000,405 | B2 * | 6/2018 | Nemire | C03B 9/325 |
| 10,414,077 | B2 * | 9/2019 | Field | B65D 1/0276 |
| 10,569,924 | B2 * | 2/2020 | Jarman | B65D 41/3428 |
| 10,894,625 | B1 * | 1/2021 | Wilson | C08J 7/06 |
| 11,746,185 | B2 * | 9/2023 | Thompson | B65D 1/0284 215/44 |
| 2003/0031885 | A1 | 2/2003 | Shiau et al. | |
| 2003/0087030 | A1 | 5/2003 | Hama et al. | |
| 2003/0116525 | A1 * | 6/2003 | Futral | B65D 1/0276 215/373 |
| 2003/0203143 | A1 | 10/2003 | Nagashima | |
| 2003/0235667 | A1 | 12/2003 | Darr et al. | |
| 2004/0031770 | A1 * | 2/2004 | Gardner | B65D 1/0246 215/297 |
| 2005/0147776 | A1 | 7/2005 | Cheng | |
| 2005/0247662 | A1 * | 11/2005 | Esmond | B65D 51/18 215/320 |
| 2006/0099362 | A1 | 5/2006 | Farha | |
| 2006/0099363 | A1 | 5/2006 | Farha | |
| 2008/0011706 | A1 * | 1/2008 | Downing | B65D 1/0246 215/256 |
| 2008/0197100 | A1 * | 8/2008 | Faulconnier | B65D 41/62 215/250 |
| 2009/0220717 | A1 | 9/2009 | Wilczak et al. | |
| 2009/0270555 | A1 | 10/2009 | Satoh et al. | |
| 2009/0280268 | A1 | 11/2009 | Glukhoy et al. | |
| 2009/0284421 | A1 | 11/2009 | Glukhoy et al. | |
| 2010/0012617 | A1 * | 1/2010 | Ulibarri | B65D 1/0276 215/371 |
| 2011/0120936 | A1 | 5/2011 | Escobar et al. | |
| 2012/0012595 | A1 * | 1/2012 | Yourist | B29C 49/04 264/572 |
| 2013/0071649 | A1 | 3/2013 | Hanger et al. | |
| 2013/0323423 | A1 | 12/2013 | Nakaya et al. | |
| 2014/0130693 | A1 | 5/2014 | Sugasaki | |
| 2015/0203222 | A1 | 7/2015 | Zonato | |
| 2016/0185498 | A1 | 6/2016 | Henderson | |
| 2016/0186309 | A1 | 6/2016 | Henderson | |
| 2018/0265243 | A1 * | 9/2018 | Gutekunst | B65D 1/42 |
| 2019/0133358 | A1 * | 5/2019 | Clyde | B65D 1/0276 |
| 2019/0161855 | A1 | 5/2019 | Kytzia et al. | |
| 2020/0283185 | A1 * | 9/2020 | Ritzen | B65D 1/0223 |
| 2022/0055786 | A1 * | 2/2022 | Fournier | B65D 23/0842 |

FOREIGN PATENT DOCUMENTS

| | | | | |
|---|---|---|---|---|
| EP | 0051443 | B1 | 1/1986 | |
| EP | 1277661 | A1 * | 1/2003 | B65D 1/0253 |
| EP | 1847507 | A1 | 10/2007 | |
| EP | 2522588 | * | 11/2012 | B66D 1/02 |
| EP | 3715500 | A1 | 9/2020 | |
| ES | 1072162 | * | 5/2010 | Y02W 30/80 |
| GB | 2207439 | B | 2/1992 | |
| JP | H03275327 | A | 12/1991 | |
| JP | 2001163370 | A | 6/2001 | |
| JP | 2017159956 | A * | 9/2017 | |
| JP | 2018062378 | A * | 4/2018 | |
| JP | 2018-150076 | A | 9/2018 | |
| KR | 20070078849 | A | 8/2007 | |
| WO | 1998/012127 | A1 | 3/1998 | |
| WO | 2002049923 | A2 | 6/2002 | |
| WO | 03/014412 | A1 | 2/2003 | |
| WO | 2006052659 | A2 | 5/2006 | |
| WO | WO 2009/081029 | * | 7/2009 | B65D 1/0215 |
| WO | 2011140473 | A1 | 11/2011 | |
| WO | 2017036866 | A1 | 3/2017 | |
| WO | WO 2018/203146 | * | 11/2018 | B65D 1/02 |

OTHER PUBLICATIONS

"The Perfect Fit: Wine Bottle Dimensions for Shipping", Hillebrand GORI, accessed online Oct. 2023, https://www.hillebrandgori.com/media/publication/wine-bottle-dimensions (Year: 2023).*

"Bronco Wine Co. Introduces 750 mL PET Bottles for Its Leading Wine Brands", Amcor Rigid Plastics, Oct. 18, 2015, https://www.amcor.com/media/news/b/bronco-wine-co-introduces-750ml-pet-bottles-for-its-leading-wine-brands (Year: 2015).*

Amcor Rigid Plastics, "Lightweights for the American Wine Industry," Jan. 13, 2012, 4 pgs.

Amcor Rigid Plastics, "Bronco Wine Co. Introduces 750ml PET Bottles for Its Leading Wine Brands," Oct. 18, 2015, downloaded from: https://www.amcor.com/media/news/b/bronco-wine-co-introduces-750ml-pet-bottles-for-its-leading-wine-brands, 9 pgs.

Paben, Jared, "Company unveils RPET bottle with recycling-friendly barrier coating," Plastics Recycling Update, Oct. 31, 2019, downloaded from: https://resource-recycling.com/plastics/2019/10/31/company-unveils-rpet-bottle-with-recycling-friendly-barrier-coating/, 4 pgs.

Database WPI Week 200159, Thomson Scientific, London, GB, 2017 Clarivate Analytics, 1 pg.

International Search Report and Written Opinion mailed May 4, 2021, from ISA/European Patent Office, for International Patent Application No. PCT/US2020/064936 (filed Dec. 14, 2020), 18 pgs.

Cork Quality Council, "Bottling Handbook for Proper Closures," 4 pgs (Jan. 2011).

* cited by examiner

LIGHTWEIGHT POLYMER WINE BOTTLE SUITABLE FOR USE WITH NATURAL CORK OR SYNTHETIC STOPPERS

RELATED APPLICATIONS

This is a NONPROVISIONAL of, claims priority to, and incorporates by reference U.S. Provisional Application No. 63/488,060, filed 2 Mar. 2023.

FIELD OF THE INVENTION

The present invention relates to packaging for alcoholic beverages, such as wine, and in particular to bottles that are fabricated from lightweight polymers and adapted to receive natural cork stoppers.

BACKGROUND

Packaging for premium alcoholic beverages, such as wine, traditionally comes in the form of glass bottles that are chemically compatible with alcohol and which have aesthetic and other appealing characteristics to consumers. Glass has long been used for such applications, in part because of its chemical compatibility, low oxygen transfer, and overall suitability for long term storage. Additionally, consumers have come to associate natural cork stoppers with premium wines and glass bottles are used, in part, because of their ability to receive and accommodate such stoppers. However, the weight and fragility of glass bottles makes them imperfect containers for these uses.

Polymeric alternatives to glass bottles have been developed. For example, wine bottles made from polyethylene terephthalate (PET) are known and offer some advantages (in terms of weight and resistance to breakage) over traditional glass bottles. The present applicant's U.S. Pat. No. 10,894,625 describes such a wine bottle; in particular, one that includes coatings on its interior and exterior surfaces that inhibit the ingress of oxygen.

However, commercially available PET wine bottle have, to date, been limited to the use of screw-top stoppers. While blind taste studies have shown that most consumers are unable to distinguish between wines stored in screw-top bottles from those using natural cork stoppers, many consumers will refuse to purchase wines in screw-top bottles because they believe those wines to be inferior to those using traditional natural cork stoppers. Similar preferences for natural cork stoppers over synthetic cork stoppers have also been observed. Moreover, many wines benefit from in-bottle aging through exposure to small amounts of oxygen introduced through natural cork stoppers. Over many years of experience with using such stoppers, wine makers have crafted their maturation and blending processes to account for their use.

This has put existing PET and other polymeric bottles at a disadvantage. Such bottles are generally unable to meet the demands associated with the use of natural (or synthetic) cork stoppers. For example, during uncorking, the release of the cork stopper from the bottle is accompanied by a sudden loss of pressurization within the bottle, and this loss of pressurization has caused the walls of PET and other polymeric bottles to recede inward, causing the wine (or other contents) of the bottle to overflow the container. And, commercial bottling lines typically utilize corking machines that first set the cork in the bottle and then tamp the cork flush with the finish by applying pressure. Some existing PET and other polymeric bottles have collapsed under the application of such pressure, making them unsuitable for such applications.

SUMMARY OF THE INVENTION

The present inventors have recognized there exists an unmet need for a lightweight, durable, rigid container that has high aesthetic appeal and allows for the use of natural cork or synthetic stoppers.

In one embodiment, a wine bottle configured in accordance with the present invention has a body that terminates in a base, a shoulder, and a neck, the shoulder forming a tapered region between the neck and the body, and the neck terminating in a finish. The wine bottle is characterized by the body, base, shoulder, neck, and finish being made of a polymer wall, which wall is sufficiently thick to withstand extraction forces, one hour after capping, of between 10 and 45 daN, and in some cases between 12 and 40 daN, when a natural cork stopper is used, and between 10 and 45 daN when a synthetic stopper is used.

By way of example, the wine bottle may be made of a polymer wall consisting of polyethylene terephthalate (PET) and/or recycled PET (rPET). Where the wine bottle has a volume of approximately 750 ml at its fill point, the polymer wall may have a thickness over the length of the body of 0.5-2 mm, and preferably approximately 1.3 mm, average, and a thickness over the length of the neck of 3.5-6.8 mm. The the neck including the finish may be 35-70 mm long and have an interior diameter of 17.75-20 mm as measured at or near a top of the finish and 17-18.5 mm at or near the junction with the shoulder. Alternatively, the neck including the finish may be of sufficient length to accommodate a stopper approximately 30-53 mm long, with a headspace sufficient to allow for expansion of wine within said bottle at temperatures above 20° C. without a pressure in the bottle rising above 1 bar. The polymer wall may have an interior coating, e.g., of an oxide of silicon, of a thickness between 1 nm and 100 μm, inclusive. The wine bottle may have a material weight (that is, an unfilled weight) of 70-300 grams.

Still another embodiment of the invention provides a wine bottle having a body that terminates in a base, a shoulder, and a neck, with the shoulder forming a tapered region between the neck and the body, and the neck terminating in a finish. The body, base, shoulder, neck, and finish may be made of a polymer wall, e.g., PET and/or rPET, and the wine bottle has a volume of approximately 750 ml at its fill point. The polymer wall has a thickness over the length of the body of approximately 1-1.7 mm on average and weighs approximately 150-160 grams.

Further embodiments of the invention are described in detail below.

BRIEF DESCRIPTION OF THE DRAWINGS

The present invention is illustrated by way of example, and not limitation, in the figures of the accompanying drawings, in which.

DETAILED DESCRIPTION

Figure 1:
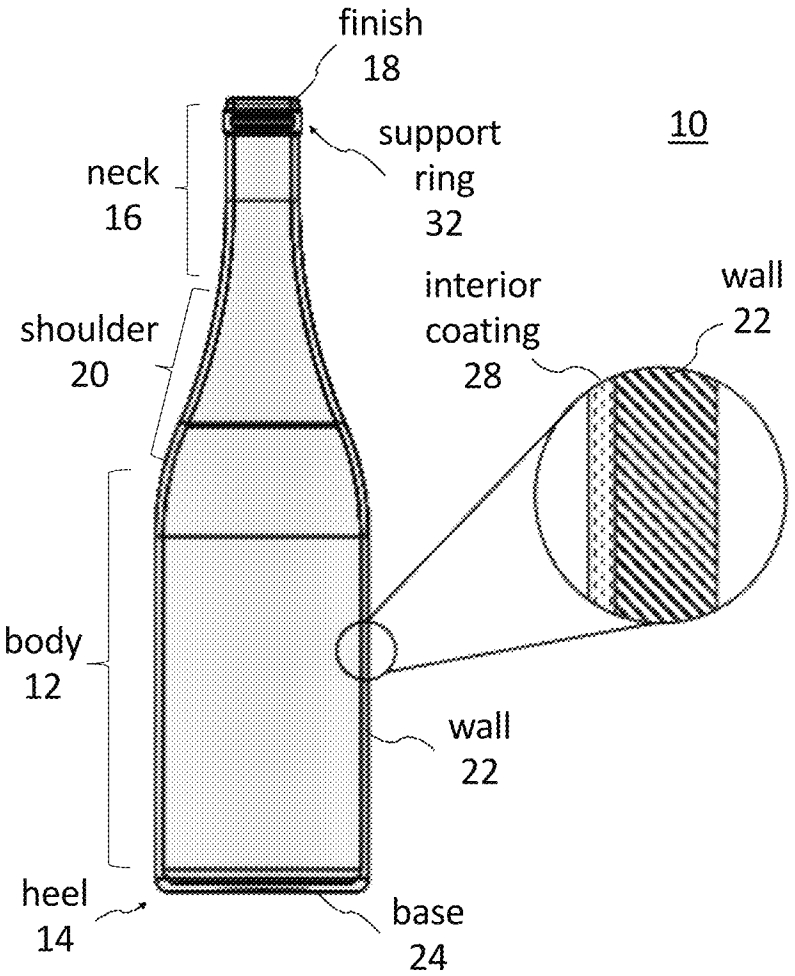
FIG. 1 illustrates an example of a wine bottle having a polymer wall and an interior coating in accordance with an embodiment of the present invention.

Described herein are embodiments of packaging for alcoholic beverages, such as wine. In one embodiment, the packaging is in the form of a bottle fabricated from a lightweight polymer, which is coated so as to prevent the ingress of oxygen. Referring to FIG. 1, in one particular embodiment a wine bottle 10 configured in accordance with the invention has a body 12 that terminates in a base 24, which may or may not include a punt (not shown), a shoulder 20, and a neck 16. The shoulder 20 forms a tapered region between the neck 16 and the body 12. Taper dimensions and shapes may vary for different bottle shapes, including bottle shapes traditionally associated with wines from Burgundy, Bordeaux, and elsewhere. The neck 16 terminates in a finish 18. Some or all of the body 12, base 24 (including a heel 14), shoulder 20, neck 16, and finish 18 are made of a clear, blow molding grade polymer wall 22, such as PET or recycled PET (rPET), having an interior coating 28. Interior coating 28 may be a coating made of an oxide of silicon (generally $SiO_x$), for example, $SiO_2$, or so-called "liquid glass." Other coatings may also be used provided that the material used for the coating should be generally impermeable to gas diffusion, oxygen in particular, and volatile compounds. The coating is preferably applied by plasma impulse chemical vapor deposition, in which a gas mixture is introduced into the bottle and ignited by microwaves to create a cold plasma that forms the interior coating, however, other coating processes may be used. The interior coating 28 may have a thickness between 1 nm and 100 μm, inclusive, and preferably 100 nm to 30 μm, inclusive. In still further embodiments, wine bottle 10 may be fashioned from one or more of polysulfone (PSU), polypropylene (PP), or glycol-modified polyethylene terephthalate (PETG). Another alternative material for wine bottle 10 is the Eastar Copolymer EB062, a copolymer based on PETG that is manufactured by the Eastman Chemical Company and has superior recyclability and chemical/mechanical properties to PET and PETG. Copolymers, blends, and mixtures of the preceding materials may also be used.

The present invention addresses various ones of the issues described above and provides a lightweight bottle for long-term storage of premium alcoholic beverages. The bulk of the bottle is made up of a polymer, e.g., PET or rPET, while the interior of the bottle is coated with a thin (e.g., preferably, between 1 nm and 100 μm thick) film of a passive barrier to (i) limit oxygen transfer into the bottle, (ii) limit the transfer of volatile organic compounds (VOCs) out of the bottle, and (iii) provide chemically compatibility with the acidic conditions associated with alcoholic beverages contained in the bottle. The exterior of the bottle may or may not be similarly coated by a thin film of the material of similar thickness. In various embodiments, bottles fabricated in accordance with embodiments of the invention weigh less than 300 grams, or even less than 200 grams, and preferably 150-160 grams or less (e.g., 70-130 grams) for a 750 ml bottle (as measured at its fill point), as compared to 500 grams for a conventional 750 ml glass wine bottle, are durable such that they can be shipped without insulating packaging material, and are suitable for long term storage of their contents (e.g., for time periods of 30-3650 days). In various embodiments, bottles fashioned in accordance with the present invention may have interior volumes ranging between approximately 0.187 to 3 liters at their fill points, with weights of such bottles varying accordingly, e.g., 30-300 grams. For Bordeaux-style or Burgundy-style bottles of approximately 750 ml at their fill points (e.g., bottles similar to those discussed in detail below), the bottles may have a material weight, that is, an unfilled weight, of 70-300 grams. Importantly, wine bottles configured in accordance with embodiments of the present invention have wall thicknesses sufficient to withstand pressures associated with corking of the bottle and to remain rigid, or nearly so, during uncorking.

In one embodiment, the polymer wall thickness of wine bottle 10 varies at different portions of the bottle. For example, the neck may have a varying thicknesses of approximately 3.5-6.8 mm at areas over its length, and the shoulder and body may have a thickness of approximately 0.5-2.5 mm on average, and more preferably 1-2 mm on average, and still more preferably 1.1-1.7 mm on average, over the length of the shoulder and body. The varying thicknesses of the different areas of the bottle allow the bottle to remain lighter than a conventional glass bottle while still providing structural support to allow for corking and uncorking.

A preferred wine bottle configured according to embodiments of the present invention is intended for storage of still wines having a level of carbonation below 1.2 grams per liter of liquid and for which over-pressure due to carbon dioxide is below one bar in a sealed bottle when kept at 20° C. The preferred wine bottle is made of PET or rPET, has a volume of approximately 750 ml at its fill point, a wall thickness of 0.5-2.5 mm on average, and preferably approximately 1-2 mm on average, and more preferably 1.1-1.7 mm on average over its body length, and 3.5-6.8 mm over its neck length, and a weight of approximately 80-160 grams, for example 150-160 grams. The neck, including the finish, may be 35-70 mm long, and preferably 40-65 mm long, with a minimum interior through bore of 17.5 mm. More generally, the neck is of sufficient length to accommodate a stopper, natural cork or synthetic cork, 30-53 mm long, and more preferably 44 mm long, with a headspace sufficient to allow for expansion of the wine at temperatures above 20° C. without the pressure in the bottle rising above 1 bar. In some cases, as discussed in greater detail below, the neck may have an interior diameter of 17.75-20 mm, and preferably 18.5-19.5 mm, as measured at or near the top of the finish (e.g., from the top to approximately 3-15 mm from the top of the finish), and 17-18.5 mm, and preferably 17.5-17.7 mm, at or near the junction with the shoulder (e.g., approximately 65 mm from the top of the finish). The preferred wine bottle is thus configured to withstand extraction forces (one hour after capping) of between 10 and 45 daN, and preferably between 12 and 40 daN, when a natural cork stopper is used and between 10 and 45 daN when a synthetic stopper is used. The preferred wine bottle is further configured to withstand corking when a compensation spring of initial force 100 daN, plus or minus 20 daN, is used.

For purposes of the present invention, natural cork stoppers suitable for use with the present wine bottles may have lengths of 38-54 mm, plus or minus 0.7 mm, and diameters of 24 mm, plus or minus 0.5 mm. In other instances, natural cork stoppers suitable for use with the present wine bottles may have lengths of may have lengths of 30-55 mm plus or minus 0.8 mm. Synthetic stoppers suitable for use with the present wine bottles may have lengths of 34-45 mm, plus or minus 0.3 mm, and diameters of 22.5-24 mm, plus or minus 0.3 mm. Diameters of the stopper should be appropriate for the diameter of the neck of the bottle and sufficient to provide adequate sealing against leakage. For example, a natural cork stopper for a bottle having an 18 mm diameter neck at the finish should be approximately 24 mm in diameter. Such a stopper will be compressed by about 6 mm when inserted into the bottle, thereby exerting a pressure of approximately 1-1.5 kg/cm$^2$ against the neck. In other instances, synthetic stoppers suitable for use with the present wine bottles may have lengths of may have lengths of 30-45 mm plus or minus 0.5 mm.

In one example, bottle 10 is manufactured via a single-stage stretch blow molding process. In this process, pellets of PET and/or rPET are fed through a hopper and through an extruder to be melted. The molten material is then injected into a preform mold which is dimensioned so as to determine the dimensions of the neck and finish of the final bottle. A stretch rod is used to stretch the preform along its longitudinal dimension and pressurized air is blown into the cavity to form the bottle material to the walls of the mold. The completed bottle is then ejected from the mold and may undergo quality control tests to ensure it does not leak.

The single-stage process is different from a two-stage process in which the preforms are made and warehoused for later blowing into completed bottles. While the two-stage process may offer some efficiencies in terms of stockpiling, etc., the present inventors have observed that reheating of the preform as part of the separate blowing process may lead to bottles having wall parameters that fail to meet the above specifications necessary to withstand corking and uncorking processes, especially when natural cork stoppers are used. Nevertheless, in some instances a two-stage stretch blow molding process may be used. In the two-stage process, once the preforms are formed they are warehoused for later forming into the final bottle forms. This final bottle formation takes place after reheating of the preforms and the two stages of the process are performed similarly to the corresponding steps single-stage procedure discussed above.

Similarly, other suitable manufacturing processes that achieve the necessary wall dimensions mentioned herein may be used. For example, extrusion blow molding may be used. In extrusion blow molding, a preform is formed vertically and its wall thickness is varied by changing the size of an orifice through which the preform extrudes. The preform is then encased in a mold and the final bottle formed by a blowing process similar to that used in blow molding, followed by trimming of any unnecessary material.

As discussed above, the interior of the polymer bottle of the present invention is coated with a thin film. The material used for the coating should be generally impermeable to gas diffusion, oxygen in particular, and volatile compounds in the case of wine. Examples of barrier materials are described in U.S. Pat. Nos. 5,300,541 (polyamide-polyepoxide coating) and 5,637,365 (epoxy-amine aryloxy/aryloate coating). There are many such coatings that have been developed commercially, including Bairocaide (available from PPG Industries of Pittsburgh, PA), EC-12 (available from Westcoat Specialty Coating Systems of San Diego, CA), Nanolok (available from InMat Inc. of Hillsborough Township, NJ), HydroPhil (available from Lotus Leaf Coatings, Inc. of Albuquerque, NM), Hydak (available from Biocoat, Inc. of Horsham, PA), and NanoScal nanotechnology coating (available from NanoScal or Conroe, TX). These commercially available coatings vary in their chemical compositions. Coatings manufactured of $SiO_x$ are often used, and are one preferred coating for use with the present wine bottles, because they are chemically similar to glass. Market research indicates that beverage manufacturers are most trusting of $SiO_x$ coatings, also referred to as "liquid glass coatings," rather than other types of coatings. Liquid glass coatings have been employed in a number of other industries including health care and automotive as a means to protect surfaces from tarnishing or corrosion. Preferably the coating should be colorless and nearly imperceptible to the human eye. The coating should be applied at a minimum to the entire interior of the bottle, in a thin continuous layer ranging from 100 nm to 30 μm. The coating may be applied in any of many methods, preferably the plasma process described above, but spraying, dipping or painting could also be used.

Bottles fashioned in accordance with the present invention may be transparent (e.g., with an optical transparency within 10% of that of glass) or translucent, and may be one of a number of colors commonly used in the premium alcohol industry, for example deaf leaf green, antique green, champagne green, or flint.

For the storage of wine, the design of the polymer bottle is of particular importance. Wine bottles are commonly produced in one of three shapes: Burgundy, Bordeaux, or Riesling. The shape of the bottle is important both for consumer appeal and for maintaining compatibility with existing bottling lines. However, in cases where wine bottle 10 does not include a punt, maintaining traditional bottle dimensions would result in a lowering of the fill line. The location of the fill line is important because it defines how much oxygen is in the bottle when it is corked. Removing the punt and keeping the fill line, while maintaining compatibility with existing bottling lines, makes the bottle design for polymer manufacturing non-trivial. Moreover, employing thinner walls than the typical glass bottle further reduces the fill line given fixed outer bottle dimensions.

For example, in one embodiment a bottle configured in accordance with the present invention which is intended for use in connection with Burgundy-style wines maintains an appropriately located fill line despite the absence of a punt and the presence thinner walls than those associated with glass wine bottles. The design is reflected in the illustration shown in FIG. 1 and it will be appreciated that the taper of the bottle begins lower down on the bottle and is, at least initially, shallower than on a typical Burgundy wine bottle. The outer diameter of the bottle is reduced slightly from a typical Burgundy wine bottle. In one embodiment, the bottle has an overall height of 290.53 mm, and an overall width (at the body) of 79.4 mm. The body is 130.5 mm tall and the neck is 37.23 mm tall. The shoulders have an inside radius of 101 mm at the junction with the body, and an outside radius of 200 mm tapering towards the neck. The foregoing dimensions and the others discussed herein are approximate and, generally, are within a tolerance of +/−3% of the specified dimension.

Figure 2:
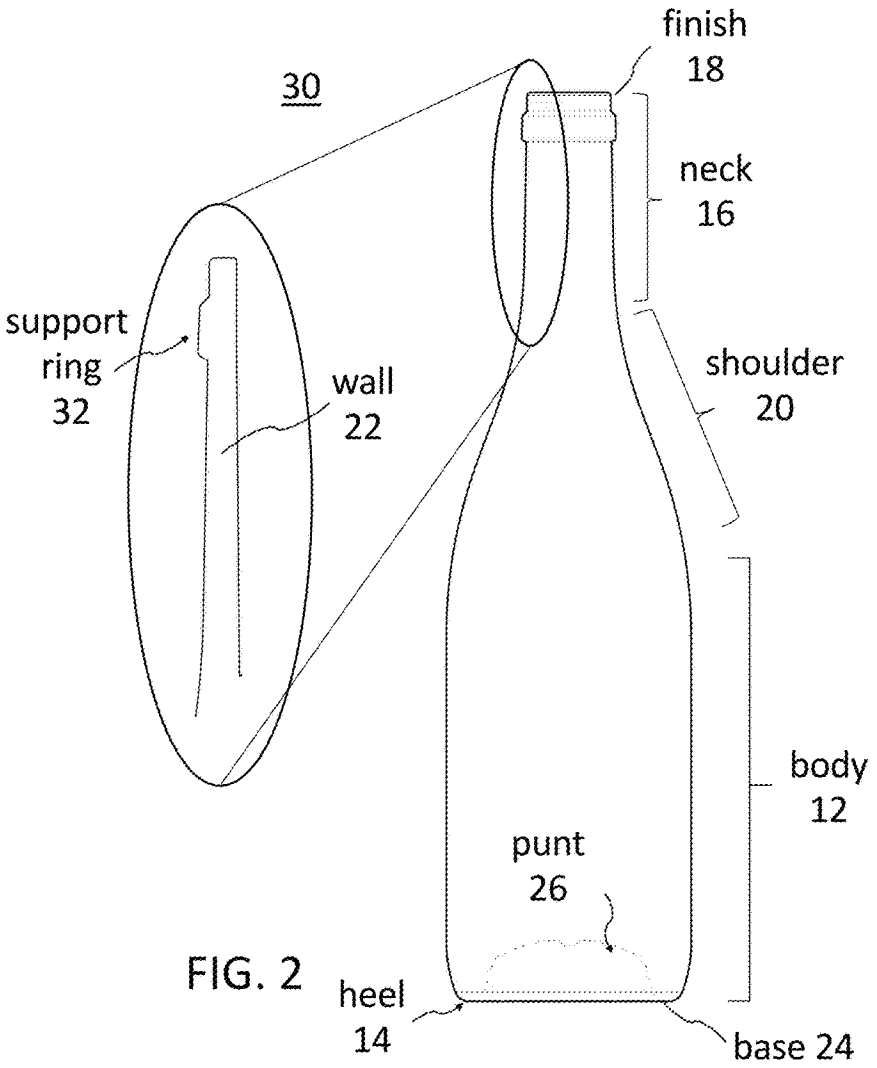
FIG. 2 illustrates a further example of a wine bottle having a polymer wall in accordance with an embodiment of the present invention, and highlights details of the neck and finish area of the bottle.

FIG. 2 illustrates another example of a wine bottle 30 configured in accordance with an embodiment of the present invention. Wine bottle 30 is similar to wine bottle 10 described above and has a body 12 that terminates in a base 24, but this base includes a punt 26, which in one embodiment is approximately 19.3-20.7 mm, and preferably approximately 20 mm, deep at its maximum point. Wine bottle 30 also includes a shoulder 20 and a neck 16 that terminates in a finish 18. The shoulder 20 forms a tapered region between the neck 16 and the body 12. Some or all of the body 12, base 24 (including heel 14), shoulder 20, neck 16, and finish 18 are made of a clear, blow molding grade polymer wall 22, such as PET or recycled PET (rPET), having an interior coating as discussed above. Wine bottle 30 is formed in a bottle shape traditionally associated with wines from Burgundy and in instances where wine bottle 30 has a volume of 750 ml bottle as measured at its fill point, approximately 63 mm from the top of the finish, has an overall height of 291.5-294.5 mm, and preferably 293 mm, and is, in one embodiment, fabricated via a single stage stretch blow molding process so as to weigh 150-160 grams or less (e.g., 70-130 grams). Others of the manufacturing processes described above may also be used.

FIG. 2 also highlights details of the neck and finish area of wine bottle 30. In this example, the neck has an interior minimum thru bore of 17.5 mm, and an interior diameter of 17.75-20 mm, and preferably 18.5-19.5 mm and, in one embodiment approximately 19 mm, as measured at or near the top of the finish, and 17-18.5 mm, and preferably 17.5-17.7 mm, as measured at or near the junction with the shoulder (e.g., approximately 65 mm from the top of the finish). Wall 22 has a thickness of 3.5-4.5 mm, and preferably approximately 4 mm, at the top of the finish, a thickness of 6.2-5.3 mm, and preferably approximately 5.75 mm, at neck support ring 32 (e.g., approximately 15 mm from the top of the finish), a thickness of 5.9-4.1 mm, and preferably approximately 5 mm, at a position approximately 45 mm from the top of the finish, and a thickness of 6.8-4.8 mm, and preferably approximately 5.8 mm, at or near the junction with the shoulder (e.g., approximately 65 mm from the top of the finish). In the body region, the wall has a thickness of approximately 0.5-2 mm on average, preferably 1-1.5 mm on average, and more preferably approximately 1.3 mm on average, over the length of the body. The neck is of sufficient length to accommodate a stopper, natural cork or synthetic cork. 38-53 mm long, and more preferably 44-45 mm long, with a headspace sufficient to allow for expansion of the wine at temperatures above 20° C. without the pressure in the bottle rising above 1 bar. Wine bottle 30 is thus configured to withstand extraction forces (one hour after capping) of between 10 and 45 daN, and preferably between 12 and 40 daN, when a natural cork stopper is used and between 10 and 45 daN when a synthetic stopper is used. Wine bottle 30 is further configured to withstand corking when a compensation spring of initial force 100 daN, plus or minus 20 daN, is used.

Figure 3:
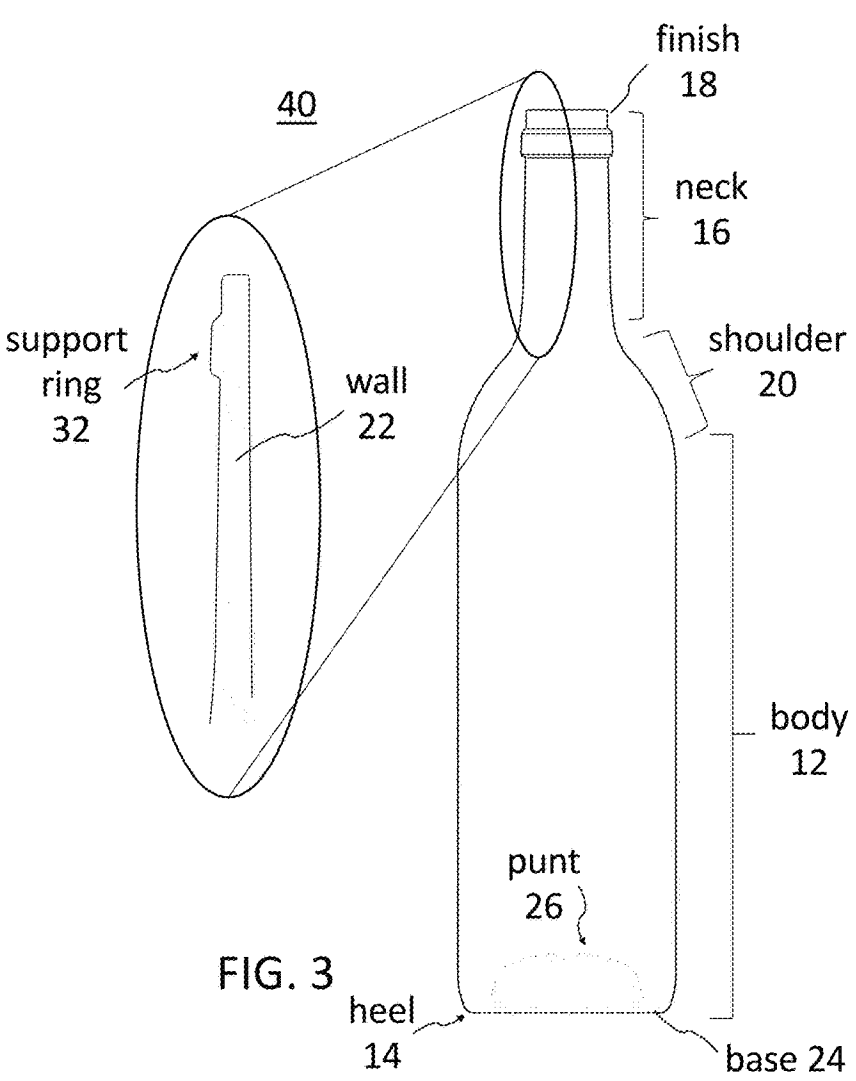
FIG. 3 illustrates yet another example of a wine bottle having a polymer wall in accordance with an embodiment of the present invention, and highlights details of the neck and finish area of the bottle.

FIG. 3 illustrates another example of a wine bottle 40 configured in accordance with an embodiment of the present invention. Wine bottle 40 is similar to wine bottle 10 described above, and has a body 12 that terminates in a base 24, but as with wine bottle 30 this base includes a punt 26, which in one embodiment is approximately 19.3-20.7 mm, and preferably approximately 20 mm, deep at its maximum point. Wine bottle 40 also includes a shoulder 20 and a neck 16 that terminates in a finish 18. The shoulder 20 forms a tapered region between the neck 16 and the body 12. Some or all of the body 12, base 24 (including heel 14), shoulder 20, neck 16, and finish 18 are made of a clear, blow molding grade polymer wall 22, such as PET or recycled PET (rPET), having an interior coating as discussed above. Wine bottle 40 is formed in a bottle shape traditionally associated with wines from Bordeaux and in instances where wine bottle 40 has a volume of 750 ml bottle as measured at its fill point, approximately 63 mm from the top of the finish, has an overall height of 299-302 mm, and preferably 300.5 mm, and is, in one embodiment, fabricated via a single stage stretch blow molding process so as to weigh 150-160 grams or less (e.g., 80-130 grams). Others of the manufacturing processes described above may also be used.

FIG. 3 also highlights details of the neck and finish area of wine bottle 40. In this example, the neck has an interior minimum thru bore of 17.5 mm, and an interior diameter of 17.75-20 mm, and preferably 18.5-19 mm, and, in one embodiment approximately 19 mm, as measured at or near the top of the finish, and 17-18.5 mm, and preferably 17.5-17.7 mm, as measured at or near the junction with the shoulder (e.g., approximately 65 mm from the top of the finish). Wall 22 has a thickness of 3.5-4.5 mm, and preferably approximately 4 mm, at the top of the finish, a thickness of 6.2-5.3 mm, and preferably approximately 5.75 mm, at neck support ring 32 (e.g., approximately 15 mm from the top of the finish), a thickness of 5.9-4.1 mm, and preferably approximately 5 mm, at a position approximately 45 mm from the top of the finish, and a thickness of 6.8-4.8 mm, and preferably approximately 5.8 mm, at or near the junction with the shoulder (e.g., approximately 65 mm from the top of the finish). In the body region, the wall has a thickness of approximately 0.5-2 mm on average, preferably 1-1.7 mm on average, and more preferably approximately 1.3 mm on average, over the length of the body. The neck is of sufficient length to accommodate a stopper, natural cork or synthetic cork, 38-53 mm long, and more preferably 44-45 mm long, with a headspace sufficient to allow for expansion of the wine at temperatures above 20° C. without the pressure in the bottle rising above 1 bar. Wine bottle 40 is thus configured to withstand extraction forces (one hour after capping) of between 10 and 45 daN, and preferably between 12 and 40 daN, when a natural cork stopper is used and between 10 and 45 daN when a synthetic stopper is used. Wine bottle 40 is further configured to withstand corking when a compensation spring of initial force 100 daN, plus or minus 20 daN, is used.

Experiments were conducted to ensure that bottles configured in accordance with embodiments of the present invention can withstand expected corking/uncorking forces. The experiments involved both Burgundy-style and Bordeaux-style bottles, similar to those illustrated in FIGS. 2 and 3, and Table 1, below, provides details concerning these samples. The Burgundy-style bottles had an average weight of approximately 155 grams, an overall height of approximately 293 mm, and an average fill point capacity of approximately 750 ml. The Bordeaux-style bottles had an average weight of approximately 157 grams, an overall height of approximately 300 mm, and an average fill point capacity of approximately 750 ml. Each of the samples were tested and determined to have a top load capacity in excess of 1000 N, which is deemed sufficient to withstand the corking and uncorking forces expected to be experienced. In Table 1, the reported wall thickness measurements represent averages of such measurements taken at each of a plurality of equally-spaced points around the circumference of the respective bottle at a specified measurement height from the bottom of the bottle, as indicated.

TABLE 2

Details for Sample Bottles Under Test
Burgundy-style Bottles

| | Measurement height from bottom of bottle (approx.) | Average wall thickness at measurement position (mm) |
|---|---|---|
| Sample 1 | Body mid-line | 1.16 |
| | Body lower one-third | 1.41 |
| | Body lower one-fifth | 1.51 |
| Sample 2 | Body mid-line | 1.15 |
| | Body lower one-third | 1.40 |
| | Body lower one-fifth | 1.53 |

TABLE 2-continued

| Details for Sample Bottles Under Test | | |
|---|---|---|
| Burgundy-style Bottles | | |
| | Measurement height from bottom of bottle (approx.) | Average wall thickness at measurement position (mm) |
| Sample 3 | Body mid-line | 1.13 |
| | Body lower one-third | 1.40 |
| | Body lower one-fifth | 1.51 |
| Sample 4 | Body mid-line | 1.15 |
| | Body lower one-third | 1.39 |
| | Body lower one-fifth | 1.52 |
| Bordeaux-style Bottles | | |
| Sample 1 | Body mid-line | 1.31 |
| | Body lower one-third | 1.52 |
| | Body lower one-fifth | 1.69 |
| Sample 2 | Body mid-line | 1.33 |
| | Body lower one-third | 1.55 |
| | Body lower one-fifth | 1.71 |
| Sample 3 | Body mid-line | 1.32 |
| | Body lower one-third | 1.54 |
| | Body lower one-fifth | 1.70 |
| Sample 4 | Body mid-line | 1.32 |
| | Body lower one-third | 1.54 |
| | Body lower one-fifth | 1.69 |

In addition to the above tests and measurements, bottles having other wall thicknesses and weights were tested. In particular, bottles having wall thicknesses of 1 mm on average and weighing 131 grams and bottles having wall thicknesses of 0.8 mm on average and weighing 113 grams were tested. These bottles were observed to withstand corking and uncorking without deforming, although bottles having wall thicknesses less than 1 mm on average were observed to be deformable by hand. Additionally, Burgundy-style and Bordeaux style bottles with filled volumes of approximately 750 ml but having bottle material weights below 70 g would be unlikely to be able to withstand corking and uncorking forces.

As mentioned above, bottles configured in accordance with embodiments of the present invention may have volumes other than 750 ml. However, in order to ensure that such bottles withstand forces associated with corking and uncorking, as well as to be able to accommodate natural cork or synthetic stoppers of conventional sizes, such bottles, regardless of volume, are fabricated to have neck dimensions and neck wall thicknesses of the same dimensions mentioned above with respect to the 750 ml bottles discussed with reference to FIGS. 2 and 3. Moreover, although discussed with respect to specific instances of wine bottles, Bordeaux-style and Burgundy-style in particular, other wine bottle shapes, such as Champagne, Resiling (flûte), Hock, Port, Provence, Bocksbeutel, Chianti, Salmanazar, Jura, etc. may be fashioned according to the present invention. And, the present invention may be used for packaging for other alcoholic beverages, such as spirits, etc.

Thus, packaging for alcoholic beverages, such as wine, fabricated from a lightweight polymer, such as PET and/or rPET, has been described.

What is claimed is:

1. A wine bottle having a body that terminates in a base, a shoulder, and a neck, the shoulder forming a tapered region between the neck and the body, and the neck terminating in a finish, said wine bottle characterized in that the body, base, shoulder, neck, and finish are made of a polymer wall consisting of polyethylene terephthalate (PET) and/or recycled PET (rPET), wherein the wine bottle has a volume of approximately 750 ml at its fill point, and the polymer wall has a thickness over the length of the body of 0.5-2 mm and a thickness over the length of the neck of 3.5-6.8 mm with the thickness of the neck being greater at a junction with the shoulder than at the finish and approximately 4.1-5.9 mm at a position approximately 45 mm from the top of the finish, the neck being adapted to accommodate a stopper 38-53 mm long, and the neck having an interior diameter of 17.75-20 mm at or near a top of the finish and 17-18.5 mm at or near the junction with the shoulder.

2. The wine bottle of claim 1, wherein the neck including the finish is 35-70 mm long.

3. The wine bottle of claim 1, wherein the neck including the finish is approximately 65 mm long.

4. The wine bottle of claim 1, wherein the neck including the finish is of sufficient length to accommodate a stopper approximately 30-55 mm long, with a headspace sufficient to allow for expansion of wine within said bottle at temperatures above 20° C. without a pressure in the bottle rising above 1 bar.

5. The wine bottle of claim 1, wherein the polymer wall has an interior coating of a thickness between 1 nm and 100 μm, inclusive.

6. The wine bottle of claim 5, wherein the interior coating is an oxide of silicon.

7. The wine bottle of claim 1, wherein the bottle has a material weight of 70-300 grams.

8. The wine bottle of claim 1, wherein the polymer wall has a thickness over the length of the body of approximately 1-1.7 mm on average and when unfilled the wine bottle weighs approximately 70-130 grams.

9. The wine bottle of claim 8, wherein the wine bottle has a Bordeaux-style shape.

10. The wine bottle of claim 8, wherein the wine bottle has a Burgundy-style shape.

* * * * *